US009779703B2

(12) United States Patent
Hong et al.

(10) Patent No.: US 9,779,703 B2
(45) Date of Patent: Oct. 3, 2017

(54) TIMING CONTROLLER AND DISPLAY DEVICE INCLUDING THE SAME

(71) Applicant: Samsung Display Co., Ltd., Yongin, Gyeonggi-Do (KR)

(72) Inventors: Hyun seok Hong, Asan-si (KR); Jangseop Kim, Incheon (KR); Jinhyun Ko, Yongin-si (KR); HyunSeok Ko, Yongin-si (KR); Ung Choi, Asan-si (KR)

(73) Assignee: Samsung Display Co., Ltd. (KR)

( * ) Notice: Subject to any disclaimer, the term of this patent is extended or adjusted under 35 U.S.C. 154(b) by 163 days.

(21) Appl. No.: 14/798,193

(22) Filed: Jul. 13, 2015

(65) Prior Publication Data

US 2016/0203802 A1 Jul. 14, 2016

(30) Foreign Application Priority Data

Jan. 13, 2015 (KR) ..... 10-2015-0006137

(51) Int. Cl.

| | |
|---|---|
| ***G09G 5/395*** | (2006.01) |
| ***G09G 5/18*** | (2006.01) |
| ***G09G 5/00*** | (2006.01) |
| ***G09G 3/20*** | (2006.01) |
| *G09G 3/36* | (2006.01) |

(52) U.S. Cl.

CPC ..... *G09G 5/395* (2013.01); *G09G 3/2096* (2013.01); *G09G 5/003* (2013.01); *G09G 5/006* (2013.01); *G09G 5/18* (2013.01); *G09G 3/3648* (2013.01); *G09G 2310/08* (2013.01); *G09G 2320/103* (2013.01); *G09G 2330/021* (2013.01); *G09G 2330/06* (2013.01); *G09G 2360/18* (2013.01)

(58) Field of Classification Search

None

See application file for complete search history.

(56) References Cited

U.S. PATENT DOCUMENTS

| | | | |
|---|---|---|---|
| 8,416,461 | B2 | 4/2013 | Nakazawa |
| 8,427,551 | B2 | 4/2013 | Suzuki et al. |
| 8,593,228 | B2 | 11/2013 | Kim et al. |

(Continued)

FOREIGN PATENT DOCUMENTS

| | | |
|---|---|---|
| KR | 10-2005-0045514 | 5/2005 |
| KR | 10-2008-0054064 | 6/2008 |
| KR | 10-1475459 | 12/2014 |

*Primary Examiner* — Joni Richer

(74) *Attorney, Agent, or Firm* — Innovation Counsel LLP

(57) ABSTRACT

Provided is a timing controller configured to operate a display device. The timing controller includes a receiving unit receiving a still image signal; a transmitting unit outputting an output data used to display images; a clock frequency spreader generating a spread clock signal having a frequency value adjusted between first and second frequency values by modulating a reference clock signal; a memory system storing a first image data which corresponds to a first frame of an image, and outputting the first image data in response to the spread clock signal; and a still image managing unit communicating with the memory system in order to output the first image data as the output data. According to the timing controller, electro-magnetic interference may be reduced and operation errors of the display device may be prevented.

18 Claims, 12 Drawing Sheets

(56) References Cited

U.S. PATENT DOCUMENTS

| | | | | |
|---|---|---|---|---|
| 2005/0046898 | A1* | 3/2005 | Usami | G06F 13/1689 358/1.16 |
| 2008/0191751 | A1* | 8/2008 | Oh | H03K 5/1565 327/114 |
| 2008/0276113 | A1* | 11/2008 | Tabeta | G06F 1/08 713/500 |
| 2009/0174691 | A1* | 7/2009 | Yeo | G09G 3/2096 345/204 |
| 2010/0085368 | A1* | 4/2010 | Shin | G09G 5/006 345/534 |
| 2014/0184583 | A1* | 7/2014 | Wyatt | G09G 3/3614 345/214 |

* cited by examiner

TIMING CONTROLLER AND DISPLAY DEVICE INCLUDING THE SAME

CROSS-REFERENCE TO RELATED APPLICATIONS

This U.S. non-provisional patent application claims priority under 35 U.S.C. §119 to Korean Patent Application No. 10-2015-0006137, filed on Jan. 13, 2015, the entire contents of which are hereby incorporated by reference.

BACKGROUND

The present disclosure herein relates to electronic circuits and electronic devices, and more particularly to, a timing controller driving a display device and a display device including the same.

Recently, various kinds of electronic devices have been used. Electronic devices include one or more electronic circuits. Electronic devices perform their own functions by operating electronic circuits.

A display device is one of the electronic devices which are widely used recently. The display device provides information to a user by displaying images. The display device includes an electronic circuit referred to as a timing controller. The timing controller is used to operate the display device. In order to display a high quality image, the resolution of the display device has increased gradually. The timing controller outputs appropriate control signals to prevent an occurrence of time difference in displaying images in the display device with a high resolution.

When the resolution of the display device becomes higher, the frequency of a clock signal used to operate the display device also becomes higher. In addition, when the resolution of the display device becomes higher, the amount of power consumed to operate the display device increases too. To solve such a limitation, various kinds of techniques are being developed to reduce the amount of power consumed to operate the display device.

When the frequency of a clock signal used to operate the display device becomes higher and the operations to reduce the power consumed in operation of the display device are performed, electro-magnetic interference increases by the clock signal. When the electro-magnetic interference increases, errors may occur in the operation of a display device. Thus, methods for reducing the noise generated by the clock signal are required.

SUMMARY

The present disclosure provides a timing controller including a structure for reducing the noise generated by a clock signal and a display device. In embodiments of the inventive concept, when an image displayed on a display panel of a display device is a still image, the display device may display the still image by using an image data stored in a memory system. Furthermore, the memory system may operate in response to a spread clock signal having a frequency value which is adjusted between a first frequency value and a second frequency value.

Embodiments of the inventive concept provide a timing controller configured to operate a display device, the timing controller including: a receiving unit configured to receive a still image signal indicating that an image displayed on a display panel of a display device is a still image; a transmitting unit configured to output an output data used to display images on the display panel; a clock frequency spreader configured to generate a spread clock signal having a frequency value adjusted between first and second frequency values by modulating a reference clock signal; a memory system configured to store a first image data which corresponds to a first frame of an image displayed on the display panel and is provided through the receiving unit, and to output the first image data in response to the spread clock signal; and a still image managing unit configured to communicate with the memory system to output the first image data as a data in response to the still image signal.

In some embodiments, the spread clock signal may have the first frequency value for each modulation period according to a control of the clock frequency spreader.

In other embodiments, the first and second frequency values and the modulation period may be modified based on an operating environment of the memory system.

In still other embodiments, the memory system may be configured to store the first image data in response to the spread clock signal.

In even other embodiments, the receiving unit may be configured to operate according to eDP interface protocol.

In yet other embodiments, the memory system may be implemented as an embedded DRAM system.

In other embodiments of the inventive concept, a timing controller configured to operate a display device includes: a receiving unit configured to receive a first image data corresponding to a first frame of an image displayed on a display panel of a display device and to receive at least one between a second image data corresponding to a second frame following a first frame and a still image signal indicating that an image displayed on a display panel of a display device is a still image; a memory system configured to store a first image data; a data processing unit configured to process the second image data when a still image signal is not provided; a still image managing unit configured to communicate with the memory system to output the first image data from the memory system; and a transmitting unit configured to output one between a first image date output from the memory system and the second image date processed by the data processing unit. In this embodiment, the memory system may include a clock frequency spreader configured to generate a spread clock signal having a frequency value adjusted between first and second frequency values by modulating a reference clock signal; a memory device configured to store at least the first image data; and a memory controller configured to control the storage and the output of the first image data in response to the spread clock signal.

In some embodiments, the memory system may further include a modulation control unit configured to modify a period by which the first and second frequency values and the frequency value of the spread clock signal may be adjusted based on an operating environment thereof.

In other embodiments, the receiving unit configured to receive one between a still image signal and a continuous image signal indicating that an image displayed as a second frame is not a still image.

In still other embodiments, the data processing unit may be configured to process the second image date in response to the continuous image signal.

In even other embodiments, when the still image signal is not provided, the memory device of the memory system may be further configured to store the second image data, and the receiving unit may be further configured to receive at least one between a third image data corresponding to a third frame following the second frame and an additional still image signal indicating that an image displayed as the third frame is a still image.

In yet other embodiments, when the additional still image signal is not provided, the data processing unit may be further configured to process the third image data.

In further embodiments, the still image managing unit may be further configured to communicate with the memory system in response to the additional still image signal in order to output the second image date from the memory system.

In still further embodiments, the memory controller may be further configured to control the storage and output of the second image data in response to the spread clock signal.

In still other embodiments of the inventive concept, a display device includes: a display panel displaying images; a gate driver configured to provide gate signals to the display panel; a data driver configured to provide data voltages to the display panel; a timing controller which is configured to receive, from a host, a first image data corresponding to a first frame and a still image signal indicating that an image displayed as a second frame following the first frame is a still image, which is configured to output a output data used to generate the data voltages, and which is configured to control the gate driver and the data driver; a clock frequency spreader configured to generate a spread clock signal having a frequency value adjusted between first and second frequency values by modulating a reference clock signal; and a memory system configured to store a first image data and to output the first image data in response to the spread clock signal. In this embodiment, the timing controller may be further configured to communicate with the memory system in order to output the first image data output from the memory system as an output data in response to the still image signal.

In some embodiments, the clock frequency spreader may be configured to modulate the reference clock signal through a spread spectrum clock generation (SSCG) method.

In other embodiments, the reference clock signal may be provided from the host, or may be generated inside the timing controller.

In still other embodiments, when the still image signal is not provided from the host, the timing controller may be further configured to receive the second image data from the host, process the second image data, and output the processed second image data as the output data.

In yet other embodiments, the memory system may be implemented as an SDRAM system.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Above-mentioned features and following detailed descriptions are all exemplarily provided to help explain and clarify the inventive concept. That is, the inventive concept may be embodied in different forms and should not be construed as limited to the embodiments set forth herein. The embodiments herein are exemplified so that this disclosure will be thorough and complete, and are explanation for fully conveying the scope of the inventive concept to those skilled in the art. Therefore, when the components of the inventive concept may be implemented by several methods, it should be clarified that the inventive concept may be implemented by a specific method thereof or by any method among equivalent methods.

Herein, when an element or the like is referred to as including a specific component, or a process or the like is referred to as including a specific step is used, it will be understood that the other elements or steps may be further included. That is, the terms herein are not used to limit the spirit of the inventive concept, but merely used to describe a specific embodiment. Furthermore, the exemplary embodiments for clarifying the inventive concept also include a complementary embodiment thereof.

The terms used herein have the same meaning as commonly understood by a person with ordinary skill in the art to which the invention pertains. The generally used terms should be understood as a consistent meaning according to the context herein. Also, the terms used herein should not be interpreted in an idealized or overly formal sense unless meanings thereof are clearly defined in the specification. Hereinafter, exemplary embodiments will be described in detail with reference to the accompanying drawings.

Figure 1:
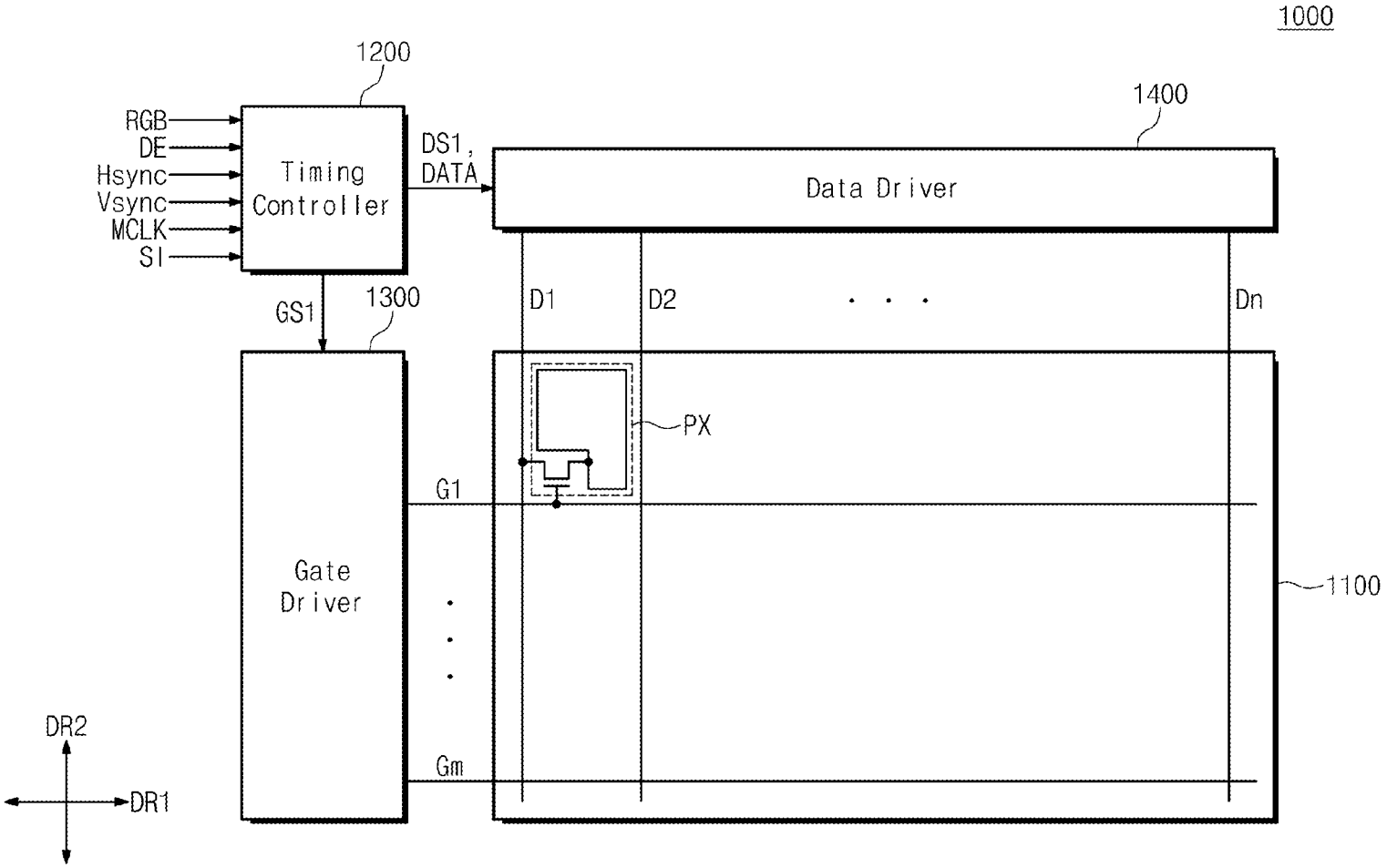
FIG. 1 is a block diagram of a display device according to an embodiment of the inventive concept.
Figure 2:
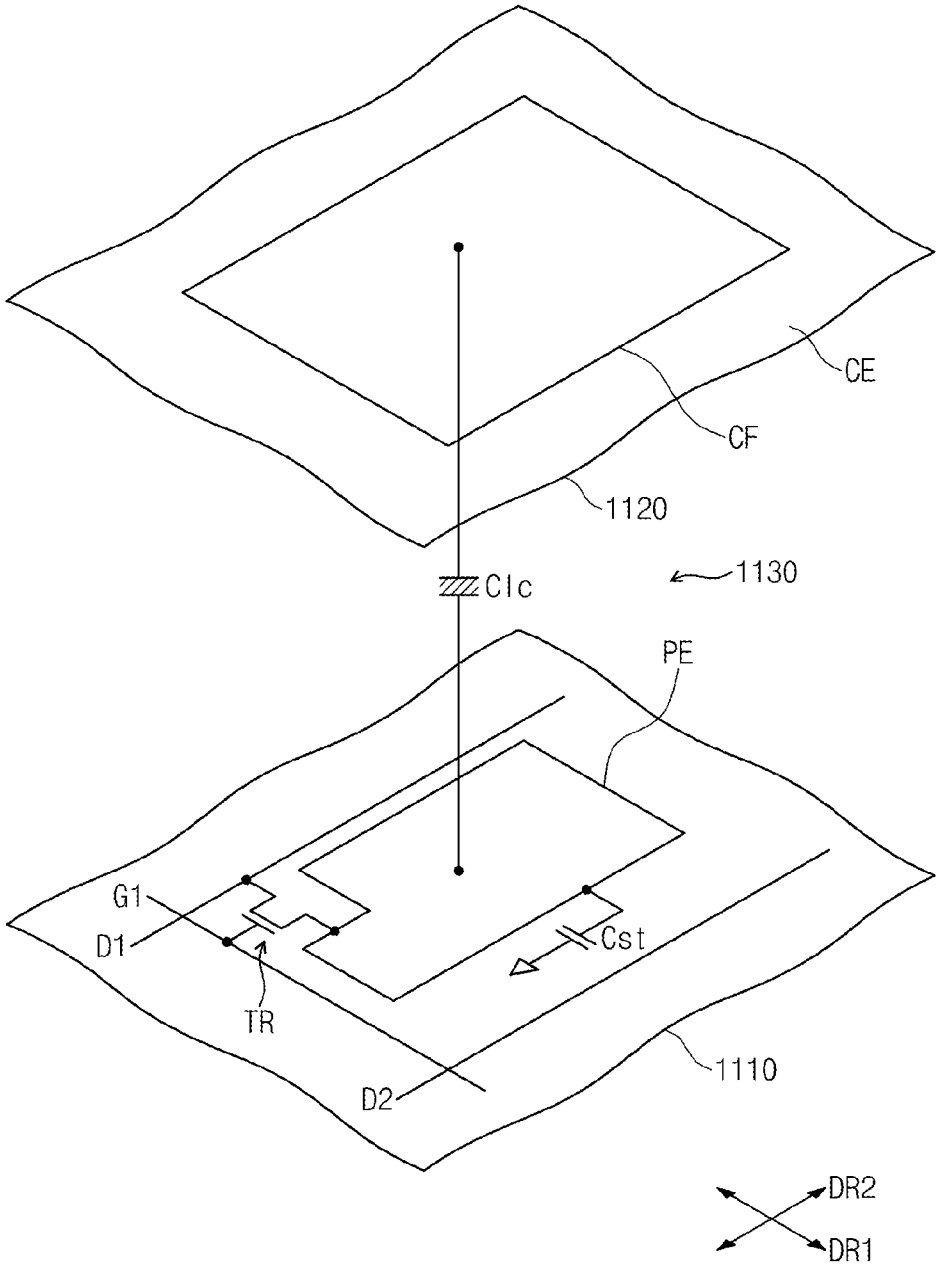
FIG. 2 is a circuit diagram illustrating an equivalent circuit of a single pixel illustrated in FIG. 1.

FIG. 1 is a block diagram of a display device according to an embodiment of the inventive concept. FIG. 2 is a circuit diagram illustrating an equivalent circuit of a single pixel illustrated in FIG. 1. For clearer understanding, FIGS. 1 and 2 are referred to at once.

Referring to FIG. 1, a display device 1000 according to an embodiment of the inventive concept may include a display panel 1100, a timing controller 1200, a gate driver 1300 and a data driver 1400. According to an embodiment, the display panel 1100 may be a liquid crystal panel, and the display device 1000 may be a liquid crystal display device. The display panel 1100 may display an image.

As an embodiment, description will be given of the display panel 1100 being a liquid crystal panel. Referring to FIG. 2, the display panel 1100 may include a lower substrate 1110, an upper substrate 1120, and a liquid crystal layer 1130. The lower substrate 1110 and the upper substrate 1120 may be disposed to face each other. The liquid crystal layer 1130 may be disposed between the lower substrate 1110 and the upper substrate 1120.

Referring again to FIG. 1, the display panel 1100 may include gate lines G1 through Gm, and data lines D1 through Dn. The gate lines G1 through Gm may extend in a first direction DR1. The data lines D1 through Dn may extend in a second direction DR2 crossing the first direction DR1. The gate lines G1 through Gm and the data lines D1 through Dn may define pixel regions. Each pixel region may include pixels PXs which is a unit for displaying an image.

As an example, FIG. 2 illustrates a pixel PX connected to a first gate line G1 and a first data line D1. The pixel PX may include a thin-film transistor TR, a liquid crystal capacitor Clc connected to the thin-film transistor TR, and a storage capacitor Cst parallely connected to the liquid capacitor Clc. However, in an embodiment, the storage capacitor Cst may not be provided.

The thin-film transistor may be disposed on the lower substrate 1110. A gate terminal of the thin-film transistor TR may be connected to the first gate line G1. A source terminal of the thin-film transistor TR may be connected to the first data line D1. A drain terminal of the thin-film transistor TR may be connected to the liquid crystal capacitor Clc and the storage capacitor Cst.

One end of the liquid crystal capacitor Clc may be connected to a pixel electrode PE disposed on the lower substrate 1110. The other end of the liquid crystal capacitor Clc may be connected to a common electrode CE disposed on the upper substrate 1120. The liquid crystal layer 1130 between the pixel electrode PE and the common electrode CE may function as a dielectric of the liquid crystal capacitor Clc. The pixel electrode PE may be connected to the thin-film transistor TR. The common electrode CE may be formed on the entire surface of the upper substrate 1120 and may receive a common voltage. However, the inventive concept is not limited to a configuration illustrated in FIG. 2. In some embodiments, the common electrode CE is disposed on the lower substrate 1110 and at least one of the pixel electrode PE or the common electrode CE may have a slit.

The storage capacitor Cst may assist the liquid crystal capacitor Clc. The storage capacitor Cst may include an insulator disposed between the pixel electrode PE and a storage line (not shown). The storage line is disposed on the lower substrate 1110, and may overlap a portion of the pixel electrode PE. The storage line may receive a constant voltage such as a storage voltage.

The pixel PX may display one of primary colors. For example, the primary colors may include red, green, blue, and white. However, the inventive concept is not limited to this example. The primary colors may further include various colors, such as yellow, cyan, and magenta. The pixel PX may further include a color filter CF used to display one of the primary colors. In FIG. 2, although the color filter CF is illustrated as being disposed on the upper substrate 1120, the inventive concept is not limited to the configuration illustrated in FIG. 2. In some embodiments, the color filter CF may be disposed on the lower substrate 1110.

Referring again to FIG. 1, the timing controller 1200 may receive an image date RGB and a control signal from a host (for example, a graphic processing unit: not shown) provided separately from the display device 1000. For example, the control signal may include a data enable signal DE, a horizontal synchronization signal Hsync, a vertical synchronization signal Vsync, and a main clock signal MCLK.

The image data RGB may include information used to display an image on the display panel 1100. The timing controller 1200 may output an output data DATA based on the image data RGB. The output data DATA may be used to display an image on the display panel 1100. The display panel 1100 may display an image by a frame unit.

The data enable signal DE may have a logical high level during a time period in which the image data RGB is provided. The horizontal synchronization signal Hsync may be referenced to distinguish the pixels arranged along rows of the display panel 1100. The vertical synchronization signal Vsync may be referenced to distinguish the frames of an image. The main clock signal MCLK may be referenced to generate one or more clock signals required for operation of the timing controller 1200.

By analyzing the image data RGB, the timing controller 1200 may determine whether the modulation of the image data RGB is necessary. When it is determined that the image data RGB is required to be modulated, the timing controller 1200 may modulate the image data RGB. When it is determined that the image data RGB is not required to be modulated, the timing controller 1200 may not modulate the image data RGB.

The timing controller 1200 may transform the image data RGB or the modulated image data so as to allow the image data RGB or the modulated image data to be suitable for the specification of the data driver 1400. The timing controller 1200 may output an output data DATA based on the image data RGB or the modulated image data. The timing controller 1200 may provide the output data DATA to the data driver 1400.

The timing controller 1200 may control the gate driver 1300 and the data driver 1400. The timing controller 1200 may generate a gate control signal GS1 used to operate the gate driver 1300. The timing controller 1200 may provide a gate control signal GS1 to the gate driver 1300. The timing controller 1200 may generate a data control signal DS1 used to operate the data driver 1400. The timing controller 1200 may provide a data control signal DS1 to the data driver 1400.

In an embodiment of the inventive concept, the timing controller 1200 may further receive a still image signal SI as a control signal. The still image signal SI may be a signal indicating that the image to be displayed on the display panel 1100 is a still image. For example, the still image signal SI may indicate that one frame of the image displayed on the display panel 1100 corresponds to a still image.

The still image signal SI may be provided from a host provided separately from the display device 1000. The host may determine whether the image to be displayed on the display panel 1100 is a still image. For example, the host may determine whether the number of times that identical frames are repeatedly displayed is greater than a reference number of times. When the number of times that identical frames are repeatedly displayed is greater than the reference number of times, the host can determine that the image to be displayed on the display panel 1100 is a still image. When the image to be displayed on the display panel 1100 is a still image, the host may provide the still image signal SI to the timing controller 1200. Thus, the host may inform the timing controller 1200 that the image to be displayed on the display panel 1100 is a still image.

When the still image signal SI is provided, the timing controller 1200 may not receive the image data corresponding to a second frame following the first frame which is a still image. Instead, the timing controller 1200 may output, as an output data DATA, the image data corresponding to the previously stored first frame. Thus, when the display panel 1100 displays a still image, the amount of power consumed by the display device 1000 and the host may be reduced. The operations of the timing controller will be further described with reference to FIGS. 3 through 6.

The display device 1000 may further include a memory system to store, in advance, the image data corresponding to the first frame. In an embodiment of the inventive concept, the memory system may operate in response to a spread clock signal having a frequency value which is adjusted between a first frequency value and a second frequency value. Thus, the noise generated by the clock signal used to operate the memory system may be reduced. The memory system may be implemented inside the timing controller 1200 or may be implemented separately from the timing controller 1200. The configurations and operations of the memory system will be further described with reference to FIGS. 7 through 13.

The gate driver 1300 may generate gate signals based on the gate control signal GS1. The gate driver 1300 may provide the gate signals to gate lines G1 through Gm. For example, the gate control signal GS1 may include a scan start signal instructing a scan start, at least one clock signal controlling the period at which a gate-on voltage is output, or an output enable signal controlling the length of the time interval in which the gate-on voltage is maintained.

The data driver 1400 may generate grayscale voltages based on the data control signal DS1. The output data DATA may be used to generate the grayscale voltages. The values of the grayscale voltages may be varied according to the output data DATA. The data driver 1400 may provide the grayscale voltages, as data voltages, to the data lines D1 through Dn.

For example, the data voltages may include positive polarity data voltages having positive values with respect to a common voltage, and negative polarity data voltages having negative values with respect to the common voltage. For example, the data control signal DS1 may include a horizontal start signal informing that the output data DATA begins to be transmitted to the data driver 1400, a load signal controlling the supplies of the data voltages to the data lines D1 through Dn, and an inverting signal inverting the polarities of the data voltages with respect to the common voltage.

For example, in order to prevent the deterioration of liquid crystals, the polarities of the data voltages applied to pixels PXs may be inverted after the display of a frame is completed and before the display of the next frame is started. That is, the polarities of the data voltages may be inverted by a frame unit in response to the inverting signal provided to the data driver 1400. For example, in order to improve the image quality displayed on the display panel 1100, when a single frame is displayed, the adjacent data lines may receive data voltages with polarities different from each other.

As an example, each of the timing controller 1200, the gate driver 1300, and the data driver 1400 may be implemented as one or more integrated circuits chips to be disposed on the display panel 1100, may be implemented on a flexible printed circuit board and is mounted on a tape carrier package (TCP) to be attached to the display panel 1100, or may be implemented on a separate printed circuit board. In another embodiment, at least one of the gate driver 1300 or the data driver 1400 may be integrated into the display panel 1100 together with the gate lines G1 through Gm, the data lines D1 through Dn, and the thin-film transistor TR. As another example, the timing controller 1200, the gate driver 1300, and the data driver 1400 may be implemented as a single integrated circuit chip.

However, the inventive concept is not limited in terms of the examples and embodiments mentioned in the descriptions with reference to FIGS. 1 and 2. For example, unlike the illustrations of FIGS. 1 and 2, the inventive concept may be also implemented when the display panel 1100 is not a liquid crystal panel. For example, the display device 1000 may further include components other than those illustrated in FIG. 1. For example, the display device 1000 may further include a scaler which processes the image data RGB so that the image data RGB includes the resolution information corresponding to the image to be displayed on the display panel 1100, a frame rate converter which adjusts the frequency of displaying frames on the display panel 1100, etc. The examples and embodiments mentioned in the descriptions with reference to FIGS. 1 and 2 are only provided to clarify the inventive concept.

Figure 3:
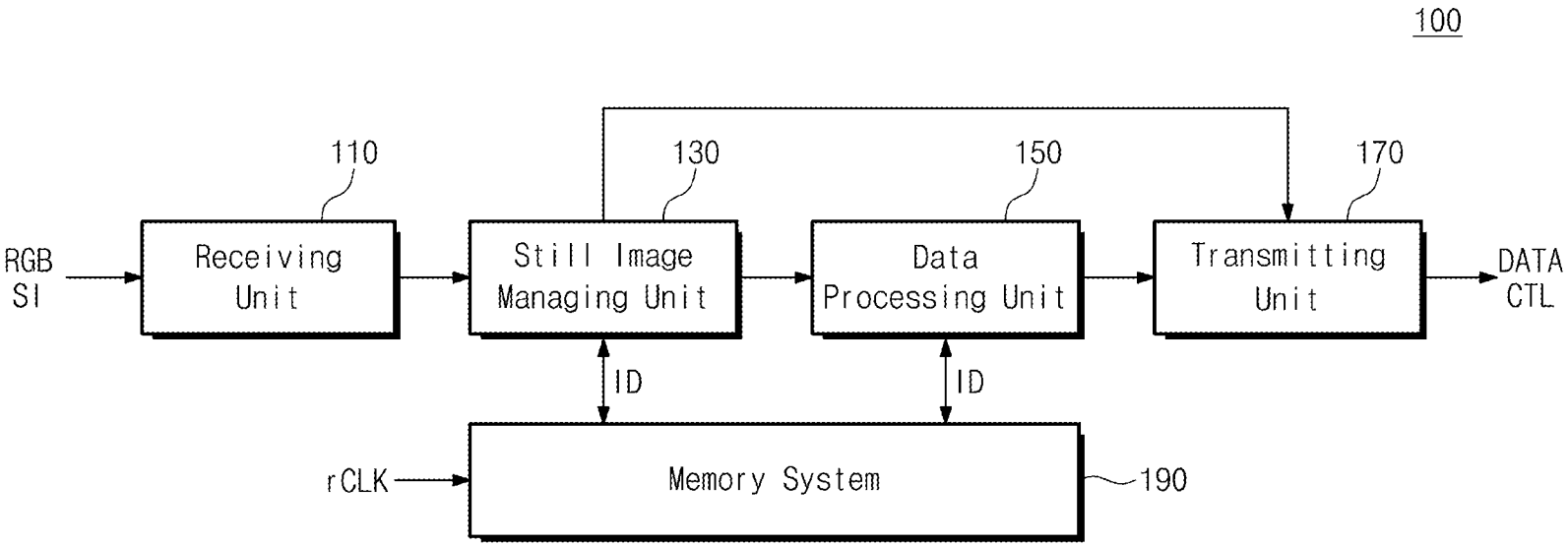
FIG. 3 is a block diagram of a timing controller according to an embodiment of the inventive concept.
Figure 4:
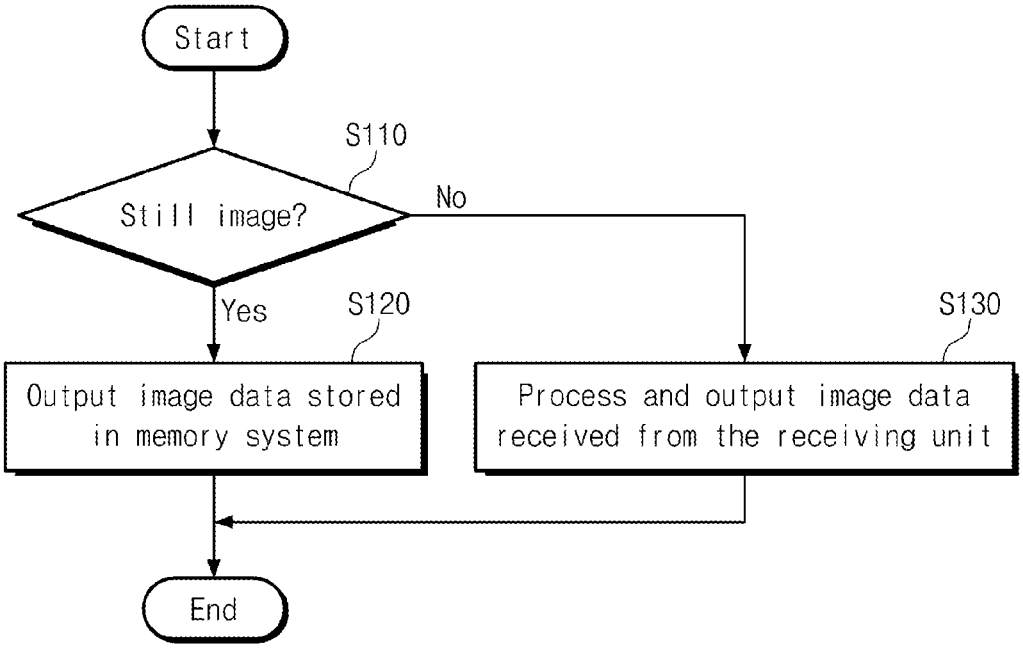
FIG. 4 is a flowchart illustrating the operation of the timing controller of FIG. 3.

FIG. 3 is a block diagram of a timing controller according to an embodiment of the inventive concept. And, FIG. 4 is a flowchart illustrating the operations of the timing controller of FIG. 3.

Referring to FIG. 3, the timing controller 100 may include a receiving unit 110, a still image managing unit 130, a data processing unit 150, transmitting unit 170, and a memory system 190. For example, the timing controller 1200 of FIG. 1 may include the timing controller 100 of FIG. 3. For example, the timing controller 100 may operate the display device 1000 of FIG. 1.

The receiving unit 110 may receive at least one of an image data RGB or a still image signal SI. As mentioned above, the image data RGB may include the information used to display an image on the display panel 1100 of FIG. 1, and the still image signal SI may indicate that the image to be displayed on the display panel 1100 is a still image. For example, the image data RGB and the still image signal SI may be provided from a host.

When the image to be displayed on the display panel 1100 is a still image, the receiving unit 110 may receive the still image signal SI. On the contrary, when the image to be displayed on the display panel 1100 is not a still image, the receiving unit 110 may not receive the still image signal SI. For example, when the image to be displayed on the display panel 1100 is not a still image, the receiving unit 110 may receive a continuous image signal. For example, the receiving unit 110 may be operated according to eDP (Embedded DisplayPort) interface protocol, but the inventive concept is not limited thereto.

The still image managing unit 130 may receive the still image signal SI through the receiving unit 110. The still image managing unit 130 may communicate with the memory system 190 in response to the still image signal SI. The operations of the still image managing unit 130 will be further described below.

The data processing unit 150 may receive the image data RGB through the receiving unit 110. The data processing unit 150 may process the image data RGB. For example, the data processing unit 150 may perform image data processing, to the image data RGB, such as pentile processing, dithering processing, pixel mapping. However, the inventive concept is not limited to the above example.

The transmitting unit 170 may output an output data DATA. As mentioned above, the output data DATA may be used to display an image on the display panel 1100. The transmitting unit 170 may further output a control signal CTL. For example, the control signal CTL may include a gate control signal GS1 (see FIG. 1) and a data control signal DS1 (see FIG. 1).

For example, the transmitting unit 170 may operate according to one or more of interface protocols, such as a low voltage differential signaling (LVDS) interface, a mini-LVDS interface, a low voltage positive/pseudo emitter coupled logic (LVPECL) interface, a current mode logic (CML) interface, a voltage mode logic (VML) interface, a high definition multimedia interface (HDMI), and an advanced intra panel interface (AIPI). However, the inventive concept is not limited to this example.

The memory system 190 may store the image data RGB provided through the receiving unit 110 or an image data ID processed by the data processing unit 150. The memory system 190 may output the stored image data ID. The memory system 190 may receive a reference clock signal rCLK. For example, the reference clock signal rCLK may be the main clock signal MCLK provided from a host or may be generated inside the timing controller 100.

The memory system 190 may store or output the image data ID in response to a spread clock signal generated through modulating the reference clock signal rCLK. The configurations and operations of the memory system and the spread clock signal will be further described with reference to FIGS. 7 through 13. For example, when the timing controller 100 includes the memory system 190, the memory system 190 may be implemented as an embedded dynamic random access memory (eDRAM) system. However, the inventive concept is not limited to this example. The kind of the memory system 190 may be variously changed or modified, if necessary.

Referring to FIGS. 3 and 4, the operation of the timing controller 100 will be described. In operation S110, it may be determined whether the image displayed on the display panel 1100 of FIG. 1 is a still image. Whether the image displayed is a still image, may be determined based on whether the still image signal SI is provided to the timing controller 100.

When the image displayed is a still image, operation S120 may be performed. In operation S120, the image data ID stored in the memory system 190 may be output as an output data DATA. When the image displayed is a still image, the timing controller 100 may not receive additional image data from the host. Instead, the timing controller 100 may output the image data ID stored in the memory system 190 through the transmitting unit 170 as an output data DATA. The still image managing unit 130 may communicate with the memory system 190 to output the image data ID stored in the memory system 190 as the output data DATA.

On the contrary, when the image displayed is not a still image, operation S130 may be performed. In operation 130, the additional image data may be provided through the receiving unit 110. The data processing unit 150 may process the additional image data. Thus, the timing controller 100 may output the image data processed by the data processing unit 150 as the output data DATA.

That is, based on whether the image displayed is a still image, the timing controller 100 may output, as the output data DATA, one of the image data ID output from the memory system 190 and the image data processed by the data processing unit 150. Hereinafter, referring to FIGS. 5 and 6, the operation of the timing controller 100 will be further described.

Figure 5:
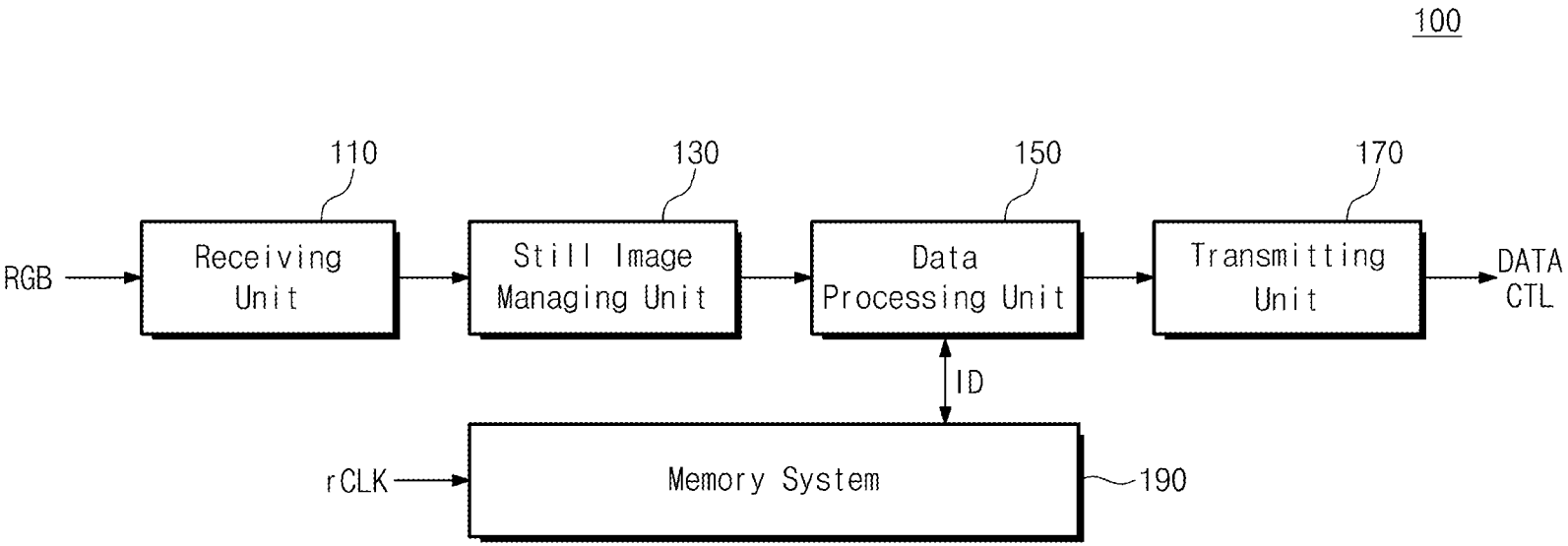
FIGS. 5 and 6 are block diagrams illustrating the operation of the timing controller of FIG. 3.
Figure 6:
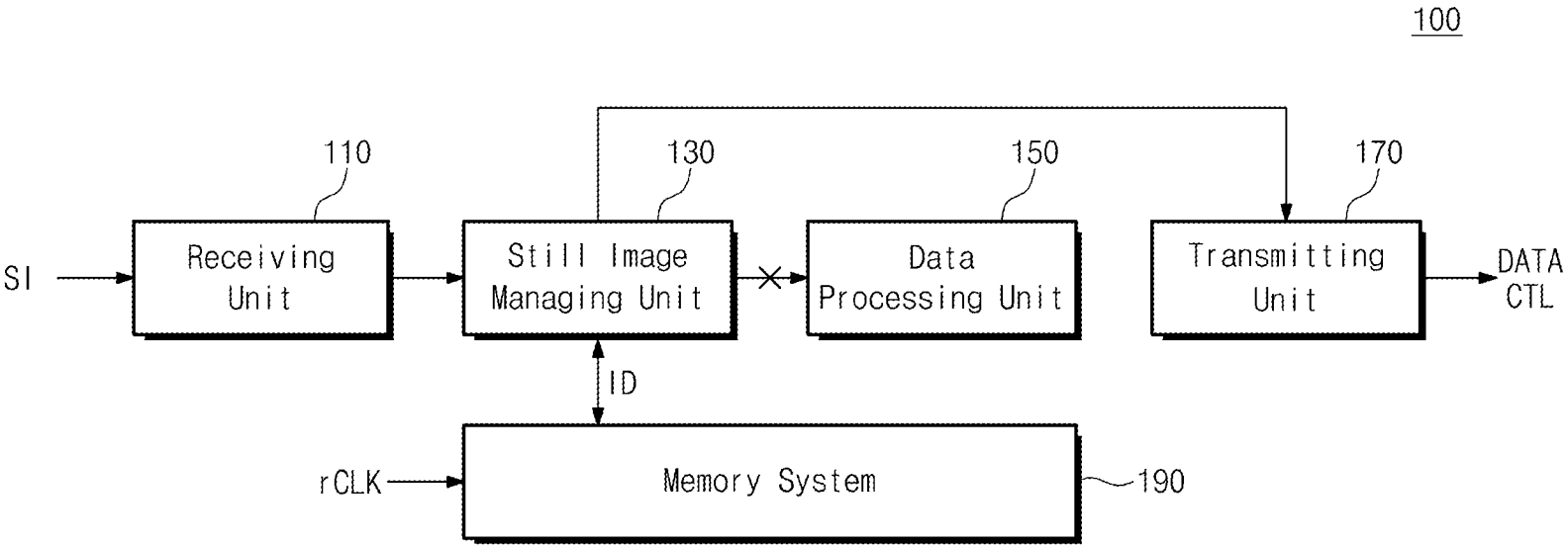

FIGS. 5 and 6 are block diagrams illustrating the operation of the timing controller of FIG. 3.

First, referring to FIG. 5, the case in which the image displayed of FIG. 1 is not a still image will be described. The receiving unit 110 may receive the image data RGB. For example, receiving unit 110 is assumed to receive a first image data corresponding to the first frame of the image displayed as the image data RGB. When the image displayed as the first frame is not a still image, the receiving unit 110 may not receive the still image signal SI from the host (see FIG. 3).

When the still image signal SI is not provided, the still image managing unit 130 may send the first image data to the data processing unit 150. However, the inventive concept is not limited to a configuration illustrated in FIG. 5. According to a design of the timing controller 100, the first image data may be provided to the data processing unit 150, not through the still image managing unit 130.

The data processing unit 150 may receive the first mage data. When the still image signal is not provided, the data processing unit 150 may process the first image data. The data processing unit 150 may perform an image data processing to the first image data to generate the output data DATA.

For example, when the image to be displayed is not a still image, the receiving unit 110 may receive a continuous image signal. The continuous image signal may indicate that the image displayed as the first frame is not a still image. The data processing unit 150 may process the first mage data in response to the continuous image signal. However, this is an example only for explaining a specific exemplary embodiment while not limiting the inventive concept.

The transmitting unit 170 may receive the first image data processed by the data processing unit 150. The transmitting unit 170 may output the first image data processed by the data processing unit 150 as the output data DATA. Furthermore, the transmitting unit 170 may further output a control signal to display an appropriate image on the display panel 1100.

The memory system 190 may store the first image data processed by the data processing unit 150. In FIG. 5, the memory system 190 is illustrated as receiving the image data ID from the data processing unit 150, but the inventive concept is not limited to a configuration illustrated in FIG. 5. According to a design of the timing controller 100, the memory system 190 may receive the image data ID through the still image managing unit 130. Otherwise, the memory system 190 may store the image data provided through the receiving unit 110 as the image data ID. Although further mentioned below, when the image displayed as the second frame following the first frame, the image data ID stored in the memory system 190 may be output through the transmitting unit 170 as the output data DATA.

After the output data DATA is output to display the first frame of an image, or while the first image data is processed, the receiving unit 110 may receive the second image data corresponding to the second frame of the image displayed as the image data RGB. When the image displayed as the second frame is not a still image, the output data DATA may be output to display the second frame of the image, according to the processes described above. That is, the second image data processed by the data processing unit 150 may be output as the output data DATA, and the memory system 190 may store the second image data processed by the data processing unit 150.

On the contrary, the image displayed as the second frame may be a still image. Referring to FIG. 6, the case in which the image displayed as the second frame is a still image will be described. When the image displayed as the second frame is a still image, the receiving unit 110 may receive the still image signal SI. The still image signal SI may indicate that the image displayed as the second frame is a still image.

When the image displayed as the second frame is a still image that is the first frame and the second frame have the same image data, the receiving unit 110 may not receive the image data RGB from the host (see FIG. 3). That is, the receiving unit 110 may not receive the second image data corresponding to the second frame from the host. Instead, in order to output the output data DATA, the data ID (that is, the first image data processed by the data processing unit 190) may be used.

In order to output the first image data as the output data DATA, the still image managing unit 130 may communicate with the memory system 190. The still image managing unit 130 may request to the memory system 190 to output the first image data in response to the still image signal SI. The memory system 190 may output the stored image data ID in response to request of the still image managing unit 130. The output image data ID, for example, may be provided to the transmitting unit 170 through the still image managing unit 130. However, the inventive concept is not limited to a configuration illustrated in FIG. 6. According to a design of the timing controller 100, the image data ID output from the memory system 190 may be provided to the transmitting unit 170 directly, not through the still image managing unit 130.

The transmitting unit 170 may receive the image data ID output from the memory system 190. The transmitting unit 170 may output the image data ID output from the memory system 190 as the output data DATA. Thus, the timing controller 100 may output, as the output data DATA, the first image data stored in advance in the memory system 190 instead of being provided with the second image data corresponding to the second frame. Furthermore, the transmitting unit 170 may further output a control signal to display an appropriate image.

According to an embodiment of the inventive concept, when the image to be displayed is a still image, the image data RGB may not be provided from a host. Instead, the image data ID stored in the memory system 190 may be output as an output data DATA. Thus, when the image to be displayed is a still image, the amount of power consumed by the display device 1000 and the host may be reduced.

After the output data DATA is output to display the still image, or while the image data ID stored in the memory system 190 is output, the still image signal SI may not be provided to the receiving unit 110. That is, the image to be displayed may be changed to a continuous image, for example, moving picture. In this case, the receiving unit 110 may receive the image data RGB. When the receiving unit 110 is provided with the image data RGB, the processes described with reference to FIG. 5 may be repeated. On the contrary, when a still image is continuously displayed, the processes described with reference to FIG. 6 may be repeated.

As described above, the memory system 190 may store or output the image data ID in response to the spread clock signal sCLK generated through modulating the reference clock signal rCLK. The spread clock signal may have a frequency value which is adjusted between a first frequency value and a second frequency value. Hereinafter, with reference to FIGS. 7 through 12, the configurations and operations of the memory system 190 and the spread clock signal will be further described.

Figure 7:
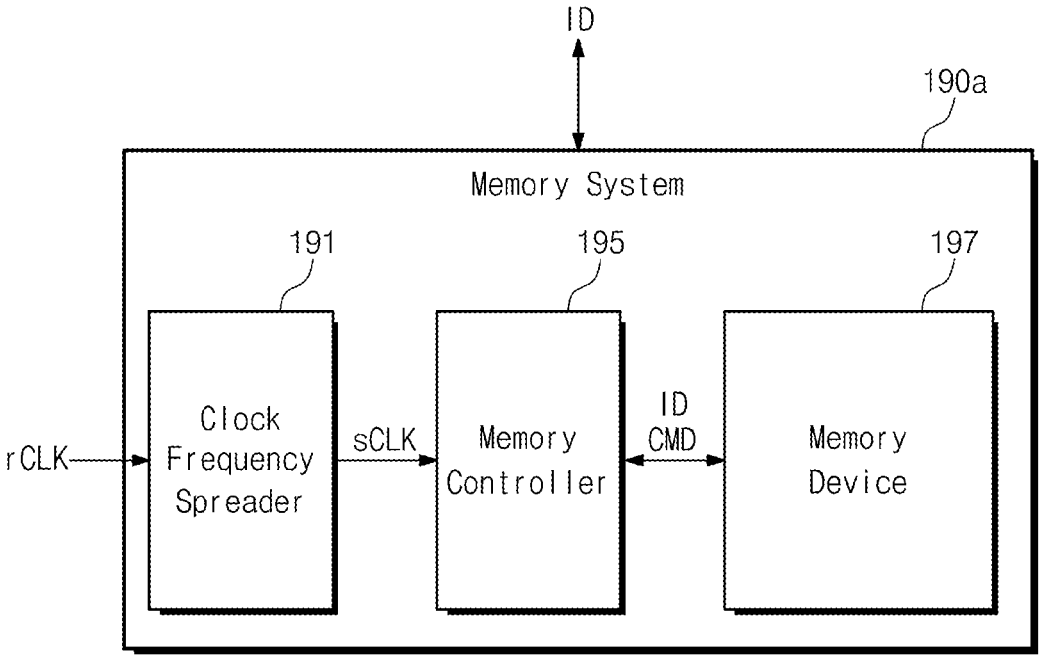
FIG. 7 is a block diagram of a memory system according to an embodiment of the inventive concept.

FIG. 7 is a block diagram of a memory system according to an embodiment of the inventive concept. Referring to FIG. 7, a memory system 190*a* may include a clock frequency spreader 191, a memory controller 195, and a memory device 197. However, the memory system 190*a* may further include components not illustrated in FIG. 7. The configuration illustrated in FIG. 7 is not limiting the inventive concept. For example, the memory system 190 of FIG. 3 may include the memory system 190*a* of FIG. 7.

The clock frequency spreader 191 may receive a reference clock signal rCLK. The reference clock signal rCLK may be modulated by the clock frequency spreader 191. More specifically, the clock frequency spreader 191 may generate a signal having a frequency value which is adjusted between a first frequency value and a second frequency value base on the reference clock signal rCLK. Thus, the clock frequency spreader 191 may generate a spread clock signal sCLK. For example, the clock frequency spreader 191 may include a phase locked loop (PLL) circuit. The generation of the spread clock signal sCLK will be further described with reference to FIGS. 8 through 10.

The memory controller 195 may receive a spread clock signal sCLK. The memory controller 195 may be operated in response to the spread clock signal sCLK. The memory controller 195 may control the storage of the image data ID in the memory device 197 or the output of the image data ID from the memory device 197, in response to the spread clock signal sCLK. The memory controller 195 may provide a command CMD to the memory device 197 to control the memory device 197.

The memory device 197 may store the image data ID according to the control of the memory controller 195. For example, the memory device 197 may store the data relating to a specific frame of the image displayed on the display panel 1100, such as the first image data corresponding to the first frame of the image displayed on the display panel 1100 of FIG. 1, and the second image data corresponding to the second frame following the first frame. When the image to be displayed is a still image, the memory device 197 may output the image data ID stored according to the memory controller 195.

In summary, the memory system 190*a* may store the image data ID used to display a still image. In an embodiment of the inventive concept, the memory system 190*a* may store or output the image data ID in response to the spread clock signal sCLK. Hereinafter, with reference to FIG. 8 through 10, the spread clock signal sCLK will be described.

Figure 8:
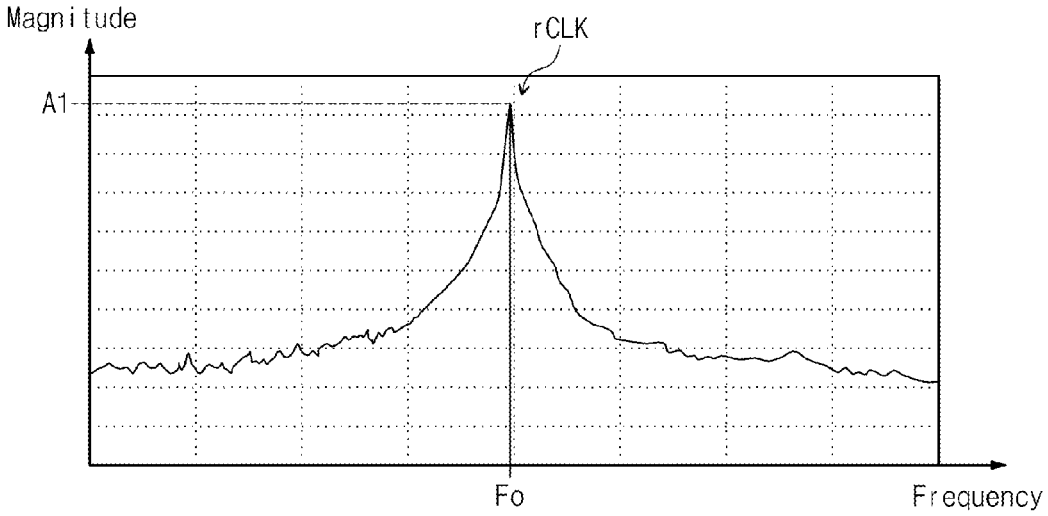
FIGS. 8 through 10 are graphs showing a spread clock signal according to an embodiment of the inventive concept.
Figure 9:
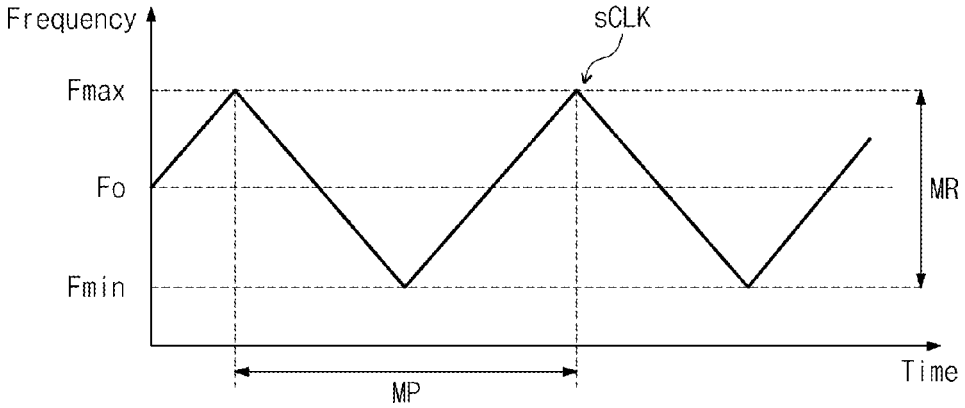
Figure 10:
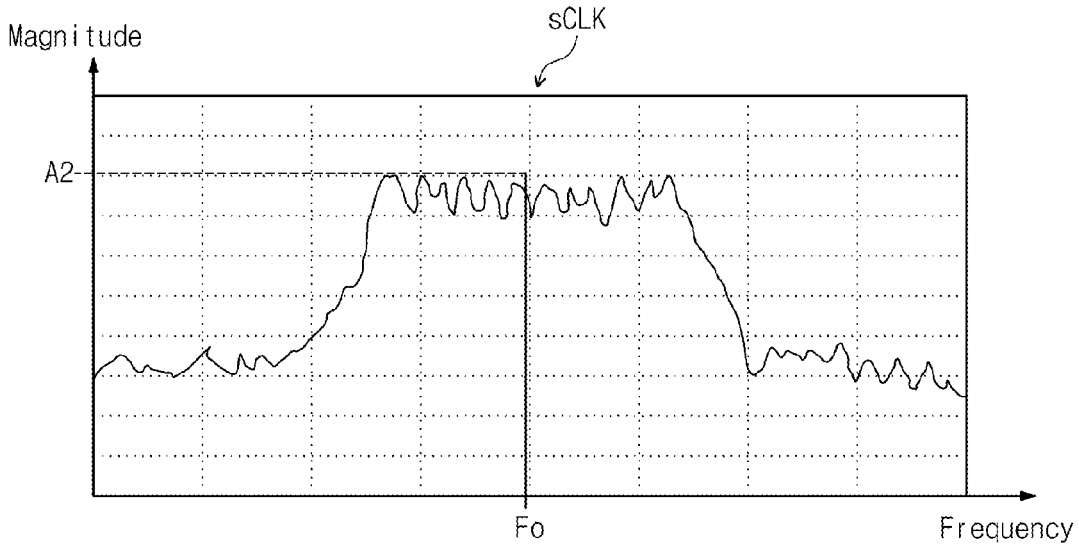

FIGS. 8 through 10 are graphs showing a spread clock signal according to an embodiment of the inventive concept.

Referring to FIG. 8, a reference clock signal rCLK having an operating frequency Fo is illustrated. For example, when the memory system 190*a* of FIG. 7 operates in response to the reference clock signal rCLK, that is not the spread clock signal sCLK (see FIG. 7), the frequency characteristic of the environment in which the memory system 190*a* operates may be illustrated by means of the graph of FIG. 8. For example, when the memory system 190*a* of FIG. 7 operates in response to the reference clock signal rCLK, the strength of the signal having an operating frequency Fo may have a first magnitude A1. As illustrated in FIG. 8, when the strength of the signal having an operating frequency Fo is remarkably strong, the noise caused by the signal having the operating frequency Fo may be increased. Also, when having a single operating frequency Fo, the peak value of the operating frequency is increased, so that the noise is increased. Furthermore, the noise caused by the signals having multiplied frequencies of the operating frequency Fo may be increased.

For example, when the memory system 190*a* is implemented as a DRAM system which operates with a high speed, such as an embedded DRAM (eDRAM), synchronous DRAM (SDRAM), the operating frequency Fo and its multiplied frequencies may have a value about several hundred MHz. A frequency band of about several hundred MHz may be used by the wireless wide area network. Thus, when the strength of the signal having an operating frequency Fo is remarkably strong, errors may occur in the operation of the display device 1000 (see FIG. 1) by the noise.

Referring to FIG. 9, a spread clock signal sCLK having an operating frequency Fo is illustrated. The clock frequency spreader 191 of FIG. 7 may generate the spread clock signal sCLK by modulating the reference clock signal rCLK of FIG. 8. For example, clock frequency spreader 191 may modulate the reference clock signal rCLK by a spread spectrum clock generation method. As illustrated in FIG. 9, the spread clock signal sCLK may have a frequency value adjusted between a first frequency value Fmax, which is the maximum value, and a second frequency value Fmin which is the minimum value.

For example, the spread clock signal sCLK may be defined by a modulation period MP and a modulation rate MR. The modulation period MP may be a period at which the frequency value of the spread clock signal sCLK is adjusted. According to the control of the clock frequency spreader 191, the spread clock signal sCLK may have the first frequency value Fmax for each modulation period MP. Otherwise, the spread clock signal sCLK may have the second frequency value Fmin for each modulation period MP.

The modulation rate MR may corresponds to a frequency interval in which the frequency value of the spread clock signal sCLK is adjusted. When the modulation rate MR becomes higher, the frequency value of the spread clock signal sCLK may be adjusted in a wider frequency interval. By changing the modulation rate MR, the first and second frequency values Fmax and Fmin may be changed.

FIG. 9 is provided to clarify the inventive concept and should not be construed as limiting the inventive concept. For example, the first and second frequency values may be interchanged with each other. For example, the frequency value of the spread clock signal sCLK may be adjusted in a nonlinear manner, which is different from that illustrated in FIG. 9. The spread clock signal sCLK may be variously changed or modified according to a design.

Referring to FIG. 10, a spread clock signal sCLK is illustrated. As illustrated in FIG. 9, when the frequency value of the spread clock signal sCLK is adjusted according to a time elapse, the frequency characteristic of the operating environment of the memory system 190*a* of FIG. 7 may be illustrated by the graph of FIG. 10. As illustrated in FIG. 9, when the frequency value of the spread clock signal sCLK is adjusted according to a time elapse, the strength of the signal having the operation frequency Fo may be a second magnitude A2 or less. When FIGS. 8 and 10 are compared, it may be understood that the strength of the signal having the operation frequency Fo may be significantly decreased (that is, A1>A2).

Thus, according to embodiments of the inventive concept, the noise caused by the signals having the operating frequency Fo and its multiplied frequencies may be decreased. Furthermore, when the memory system 190*a* operates in response to the spread clock signal sCLK according to embodiments of the inventive concept, the electro-magnetic interference caused by the noise may be decreased. As a result, the operation errors of the display device 1000 (see FIG. 1) may be prevented.

In an embodiment of the inventive concept, at least one of the first frequency value Fmax, the second frequency value Fmin, the modulation period MP, or the modulation rate MR may be variously changed or modified, if necessary. In an embodiment, the first and second frequency values Fmax and Fmin, the modulation period MP, and the modulation rate MR may be modified base on the operating environment of the memory system 190*a*.

For example, the operating environment of the memory system 190*a* is monitored periodically or for each specific time point. Based on the result of the monitoring, the first and second frequency values Fmax and Fmin, the modulation period MP, and the modulation rate MR may be modified. For example, when the strength of the signal having the operating frequency Fo is a reference value or more, the modulation rate MR may be increased. The components for modifying the first and second frequency values Fmax and Fmin, the modulation period MP, and the modulation rate MR will be described with reference to FIG. 11.

Figure 11:
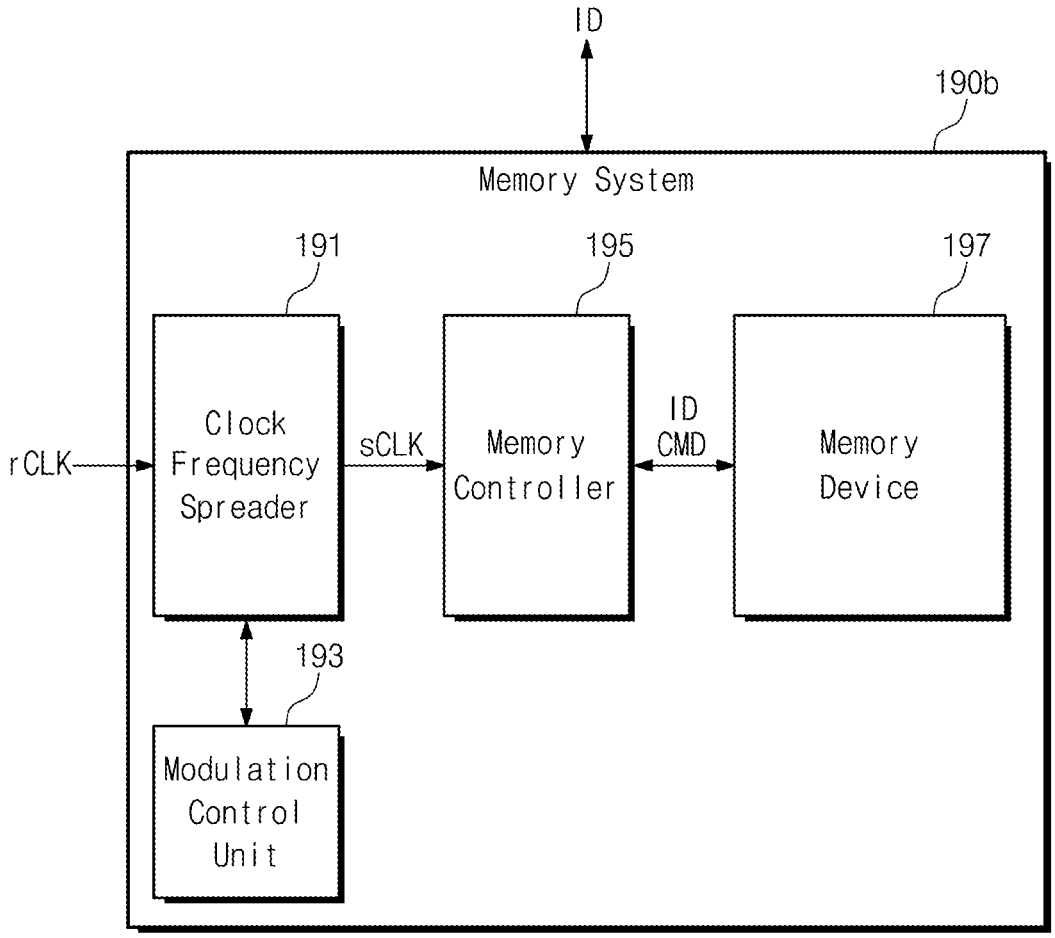
FIG. 11 is another block diagram illustrating a memory system according to an embodiment of the inventive concept.

FIG. 11 is another block diagram illustrating a memory system according to an embodiment of the inventive concept. Referring to FIG. 11, a memory system 190*b* may include a clock frequency spreader 191, a modulation control unit 193, a memory controller 195, and a memory device 197. For example, the memory system 190 of FIG. 3 may include the memory system 190*b* of FIG. 11.

The configurations and functions of the clock frequency spreader 191, the memory controller 195, and the memory device 197 of FIG. 11 may respectively include the clock frequency spreader 191, the memory controller 195, and the memory device 197 of FIG. 7. For convenience of description, overlapped descriptions relating to the configurations and functions of the clock frequency spreader 191, the memory controller 195, and the memory device 197 will not be provided.

As described above, the first and second frequency values Fmax and Fmin, the modulation period MP, and the modulation rate MR of the spread clock signal sCLK may be modified based on the operating environment of the memory system 190*b*. For example, the modulation control unit 193 may monitor the operating environment of the memory system 190*b*. The modulation control unit 193 may modify the first and second frequency values Fmax and Fmin, the modulation period MP, and the modulation rate MR of the spread clock signal sCLK according to the operating environment of the memory system 190*b*. According to the operation of the modulation control unit 193, the spread clock signal sCLK appropriate for the operating environment of the memory system 190*b* may be generated.

For example, when the strength of the signal having a specific frequency is a reference value or more, the modulation control unit 193 may modify the modulation period or the modulation rate of the spread clock signal sCLK. When the modulation period or the modulation rate of the spread clock signal sCLK is modified, the influence of the noise may be further decreased. However, when the modulation period of the spread clock signal sCLK becomes shorter or the modulation rate of the spread clock signal sCLK becomes greater, the amount of power consumed to generate the spread clock signal sCLK may be increased. Accordingly, the modulation control unit 193 may operates in view of the operating environment and the power consumption of the memory system 190*b*.

Figure 12:
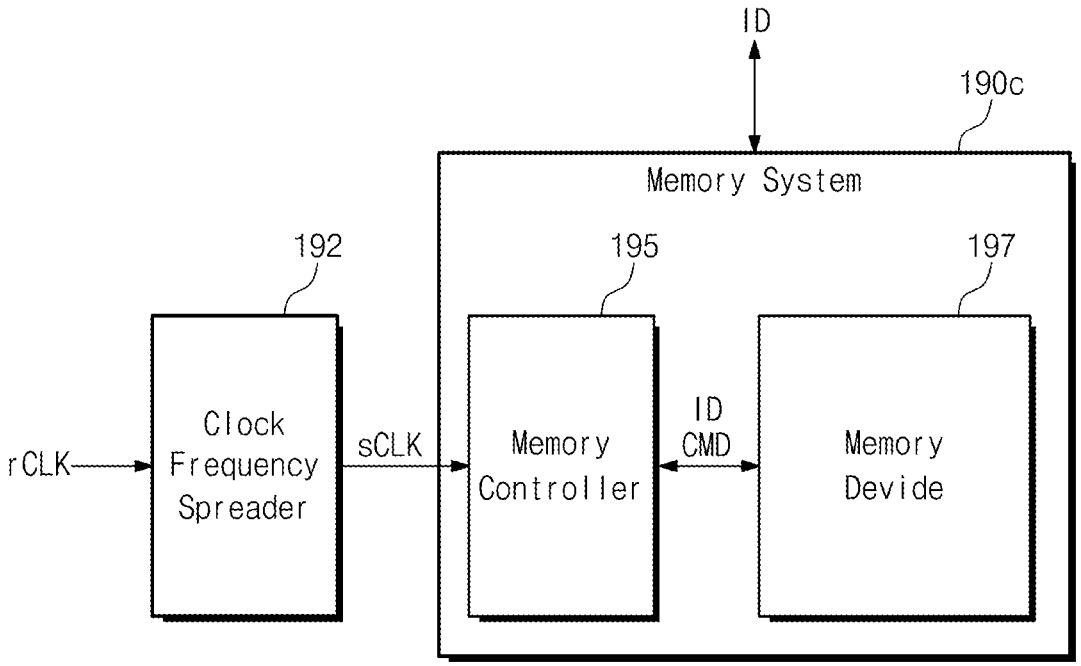
FIG. 12 is a block diagram illustrating a memory system and a clock frequency spreader according to an embodiment of the inventive concept.

FIG. 12 is a block diagram illustrating a memory system and a clock frequency spreader according to an embodiment of the inventive concept. Referring to FIG. 12, the memory system 190*c* may include a memory controller 195 and a memory device 197. In an embodiment, the clock frequency spreader 192 may be disposed separately from the memory system 190*c*. For example, the memory system 190 of FIG. 3 may include the memory system 190*c* of FIG. 12. The configurations and functions of the clock frequency spreader 192, the memory controller 195, and the memory device 197 of FIG. 12 may respectively include the clock frequency spreader 191, the memory controller 195, and the memory device 197 of FIG. 7

For convenience of description, overlapped descriptions relating to the configurations and functions of the clock frequency spreader 192, the memory controller 195, and the memory device 197 will not be provided. The clock frequency spreader according to embodiments of the inventive concept may be variously implemented. For example, as illustrated in FIG. 7, the clock frequency spreader 192 may be included in the memory system 190*a*. In another example, as illustrated in FIG. 12, clock frequency spreader 192 may be disposed separately from the memory system 190*c*. That is, according to the design of the memory system or the timing controller, the clock frequency spreader may be included inside the memory system or may be disposed separately from the memory system. As illustrated in FIG. 12, when clock frequency spreader 192 is disposed separately from the memory system 190*c*, the timing controller 100 of FIG. 3 may further include the clock frequency spreader 192 to modulate a reference clock signal rCLK.

Figure 13:
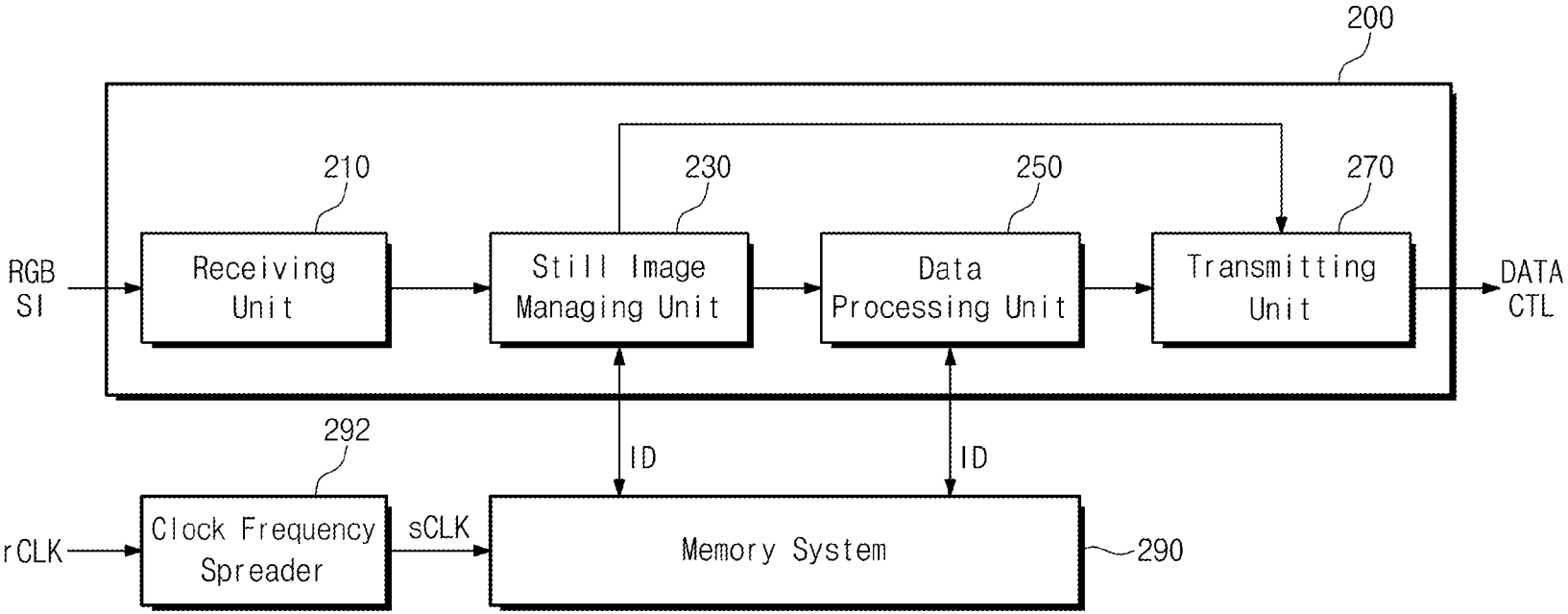
FIG. 13 is a block diagram illustrating a timing controller, a memory system and a clock frequency spreader according to an embodiment of the inventive concept.

FIG. 13 is a block diagram illustrating a timing controller, a memory system and a clock frequency spreader according to an embodiment of the inventive concept. Referring to FIG. 13, the timing controller 200 may include a receiving unit 210, a still image managing unit 230, a data processing unit 250 and a transmitting unit 270. In an embodiment, the memory system 290 and the clock frequency spreader 292 may be disposed separately from the timing controller 200. For example, the timing controller 1200 of FIG. 1 may include the timing controller 200 of FIG. 13. For example, the timing controller 200 may operate the display device 1000 of FIG. 1.

The configurations and functions of the timing controller 200, a receiving unit 210, a still image managing unit 230, a data processing unit 250, and a transmitting unit 270 of FIG. 13 may respectively include the configurations and functions of the timing controller 100, the receiving unit 110, the still image managing unit 130, the data processing unit 150, and the transmitting unit 170 of FIG. 3. For convenience of description, overlapped descriptions relating to the configurations and functions of the timing controller 200, a receiving unit 210, a still image managing unit 230, a data processing unit 250, and a transmitting unit 270 will not be provided.

The memory system according to embodiments of the inventive concept may be variously implemented. For example, as illustrated in FIG. 3, the memory system 190 may be included in the timing controller 100. In another example, as illustrated in FIG. 13, the memory system 290 may be disposed separately from the timing controller 200.

That is, according to the design of the memory system or timing controller, the memory system may be included inside the timing controller or may be disposed separately from the timing controller. For example, as illustrated in FIG. 13, when the memory system 290 is disposed separately from the timing controller 200, the memory system 290 may be implemented as an SDRAM system. However, the inventive concept is not limited to this example. The kind of the memory system 290 may be variously changed or modified, if necessary.

For example, as illustrated in FIG. 13, a clock frequency spreader 292 generating the spread clock signal sCLK according to an embodiment of the inventive concept may be disposed separately from the memory system 290. In this example, the memory system 290 may include a memory controller and a memory device. According to this example, the memory system 290 may be configured similar to the memory system 190*c* of FIG. 12.

In another embodiment, the clock frequency spreader 292 may be included in the memory system 290 together with the memory controller and the memory device, which is different from that illustrated in FIG. 13. That is, the inventive concept is not limited to a configuration illustrated in FIG. 13. According to this embodiment, the memory system 290 may be configured similar to the memory system 190*a* of FIG. 7.

The configurations and functions of the memory system 290 and the clock frequency spreader 292 of FIG. 13 may respectively include the configurations and functions of the memory system 190*a* or 190*c* and the clock frequency spreader 191 or 192, which are described above with reference to FIGS. 7 through 12. For convenience of description, overlapped descriptions relating to the configurations and functions of the memory system 290 and the clock frequency spreader 292 will not be provided. The memory system 290 may further include the modulation control unit 193 described with reference to FIG. 11, if necessary.

According to embodiments of the inventive concept, when an image to be displayed on a display panel of a display device is a still image, the noise generated by a clock signal used to operate a memory system may be reduced. Thus, according to embodiments of the inventive concept, electro-magnetic interference may be reduced and errors in the operation of the display device may be prevented.

The configuration illustrated in each schematic view should be only understood in conceptual view. For clarifying the inventive concept, the shape, the structure, and the size of each component illustrated in the schematic views are scaled up or down. The actually implemented configuration may have a different physical shape which is different from that illustrated in the schematic view. Each schematic view does not limit the physical shapes of the components.

Apparatus configuration is illustrated in each block diagram to clarify the inventive concept. Each block may be constituted by a smaller unit blocks according to functions. Otherwise, a plurality of blocks may constitute a larger unit block according to functions. That is, the inventive concept is not limited to the configuration illustrated in the block diagrams.

Hitherto, the inventive concept is described mainly with embodiments. However, in view of the characteristics of the technological field, the object of the inventive concept may be achieved in a different form from the above embodiments while including the subject matters of the inventive concept. Accordingly, the above embodiments should be understood not in a limitative view but in an illustrative view. That is, technological concepts which include subject matters of the inventive concept and which may achieve the same objects as the inventive concept should be understood to be included in the inventive concept.

Therefore, technological concepts variously changed and modified without departing from the spirit of the inventive concept are included in the claimed scope. Also, the protective scope of the inventive concept should not be construed to be limited to the above embodiments.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A timing controller comprising:

a receiver receiving a still image signal indicating that an image to be displayed is a still image;

a transmitter outputting an output data used to display images;

a clock frequency generator generating a spread clock signal having a frequency value adjusted between first and second frequency values by modulating a reference clock signal;

a memory system including a memory device, the memory device storing a first image data which corresponds to a first frame of an image displayed and is received through the receiver in response to the spread clock signal, and the memory system outputting the first image data in response to the spread clock signal; and a still image manager communicating with the memory system to output the first image data as the output data in response to the still image signal.

2. The timing controller of claim 1, wherein the spread clock signal has the first and second frequency values for each modulation period according to a control of the clock frequency generator.

3. The timing controller of claim 2, wherein the first and second frequency values and the modulation period are modified based on an operating environment of the memory system.

4. The timing controller of claim 1, wherein the receiver is configured to operate according to eDP interface protocol.

5. The timing controller of claim 1, wherein the memory system is implemented as an embedded DRAM.

6. A timing controller configured to operate a display device, the timing controller comprising:

a receiver configured to receive a first image data corresponding to a first frame of an image displayed on a display panel of the display device, and receive at least one of either a second image data or a still image signal, wherein the second image data corresponds to a second frame following a first frame, and the still image signal indicates that an image displayed on a display panel of a display device is a still image;

a memory system configured to store the first image data;

a data processor configured to process the second image data when the still image signal is not provided;

a still image manager, in response to the still image signal, configured to communicate with the memory system to output the first image data from the memory system; and a transmitter configured to output one of either a first image data output from the memory system or the second image data processed by the data processing unit, wherein the memory system includes:

a clock frequency generator configured to generate a spread clock signal having a frequency value adjusted between first and second frequency values;

a memory device configured to store the first image data in response to the spread clock signal; and a memory controller configured to control storage and output of the first image data in response to the spread clock signal.

7. The timing controller of claim 6, wherein the memory system further includes a modulation controller configured to modify a period by which the first frequency value, second frequency values, and the frequency value of the spread clock signal are adjusted based on an operating environment of the memory system.

8. The timing controller of claim 6, wherein the receiver is configured to receive one of either a still image signal or continuous image signal indicating that an image displayed as the second frame is not a still image.

9. The timing controller of claim 8, wherein the data processor is configured to process the second image date in response to the continuous image signal.

10. The timing controller of claim 6, wherein when the still image signal is not provided, the memory device of the memory system is further configured to store the second image data, and the receiver is further configured to receive at least one of either a third image data or an additional still image signal, wherein the third image data corresponds to a third frame following the second frame, and the additional still image signal indicates that an image displayed as the third frame is a still image.

11. The timing controller of claim 10, wherein when the additional still image signal is not provided, the data processor is further configured to process the third image data.

12. The timing controller of claim 10, wherein the still image manager is further configured to communicate with the memory system in response to the additional still image signal in order to output the second image data from the memory system.

13. The timing controller of claim 12, wherein the memory controller is further configured to control the storage and the output of the second image data in response to the spread clock signal.

14. A display device comprising:

a display panel;

a gate driver;

a data driver;

a timing controller which is configured to:

receive, from a host, a first image data corresponding to a first frame and a still image signal indicating that an image displayed as a second frame following the first frame is a still image, output an output data used to generate the data voltages, and control the gate driver and the data driver;

a clock frequency generator configured to generate a spread clock signal having a frequency value adjusted between first and second frequency values by modulating a reference clock signal; and a memory system including a memory device, the memory device configured to store the first image data in response to the spread clock signal and output the first image data in response to the spread clock signal, wherein the timing controller is further configured to communicate with the memory system to output the first image data output from the memory system as an output data in response to the still image signal.

15. The display device of claim 14, wherein the clock frequency generator is configured to modulate the reference clock signal through a spread spectrum clock generation (SSCG) method.

16. The display device of claim 14, wherein the reference clock signal is provided from the host, or is generated inside the timing controller.

17. The display device of claim 14, wherein when the still image signal is not provided from the host, the timing controller is further configured to receive the second image data from the host, process the second image data, and output the processed second image data as the output data.

18. The display device of claim 14, wherein the memory system is implemented as an SDRAM.

* * * * *